US008970130B1

(12) United States Patent
So

(10) Patent No.: US 8,970,130 B1
(45) Date of Patent: Mar. 3, 2015

(54) DESKTOP READING, BEDSIDE READING, AND MIDNIGHT LAMP AND RELATED METHODS

(71) Applicant: Ting Pat Albert So, Bothell, WA (US)

(72) Inventor: Ting Pat Albert So, Bothell, WA (US)

( * ) Notice: Subject to any disclaimer, the term of this patent is extended or adjusted under 35 U.S.C. 154(b) by 0 days.

(21) Appl. No.: 13/987,962

(22) Filed: Sep. 19, 2013

(51) Int. Cl.
*H05B 37/02* (2006.01)
*H05B 33/08* (2006.01)

(52) U.S. Cl.
CPC ..... *H05B 33/0845* (2013.01)
USPC ..... 315/297; 315/360

(58) Field of Classification Search
None
See application file for complete search history.

(56) References Cited

U.S. PATENT DOCUMENTS

2013/0038244 A1* 2/2013 Kamii et al. ..... 315/297
2013/0141018 A1* 6/2013 Kamii ..... 315/360

* cited by examiner

*Primary Examiner* — Jany Richardson

(57) ABSTRACT

A bedside lamp, features for such a lamp, and associated methodology. The lamp has at least two different sets of lighting elements, each having one or more groupings of LED lamp(s), where the one or more main LED lamp(s) provide the majority of the lighting when the lamp is at full brightness and no lighting during various reduced lighting states, and the one or more "auxiliary" LED lamp(s) provide less than a majority of the lighting when the lamp is at full brightness and all of the lighting during various reduced lighting states. The lamp has the means for the user to set a dimming time for which the lights dim from a set brightness to 0% brightness, and means to gradually dim the main and auxiliary LED lamp(s) according to the above description.

4 Claims, 1 Drawing Sheet

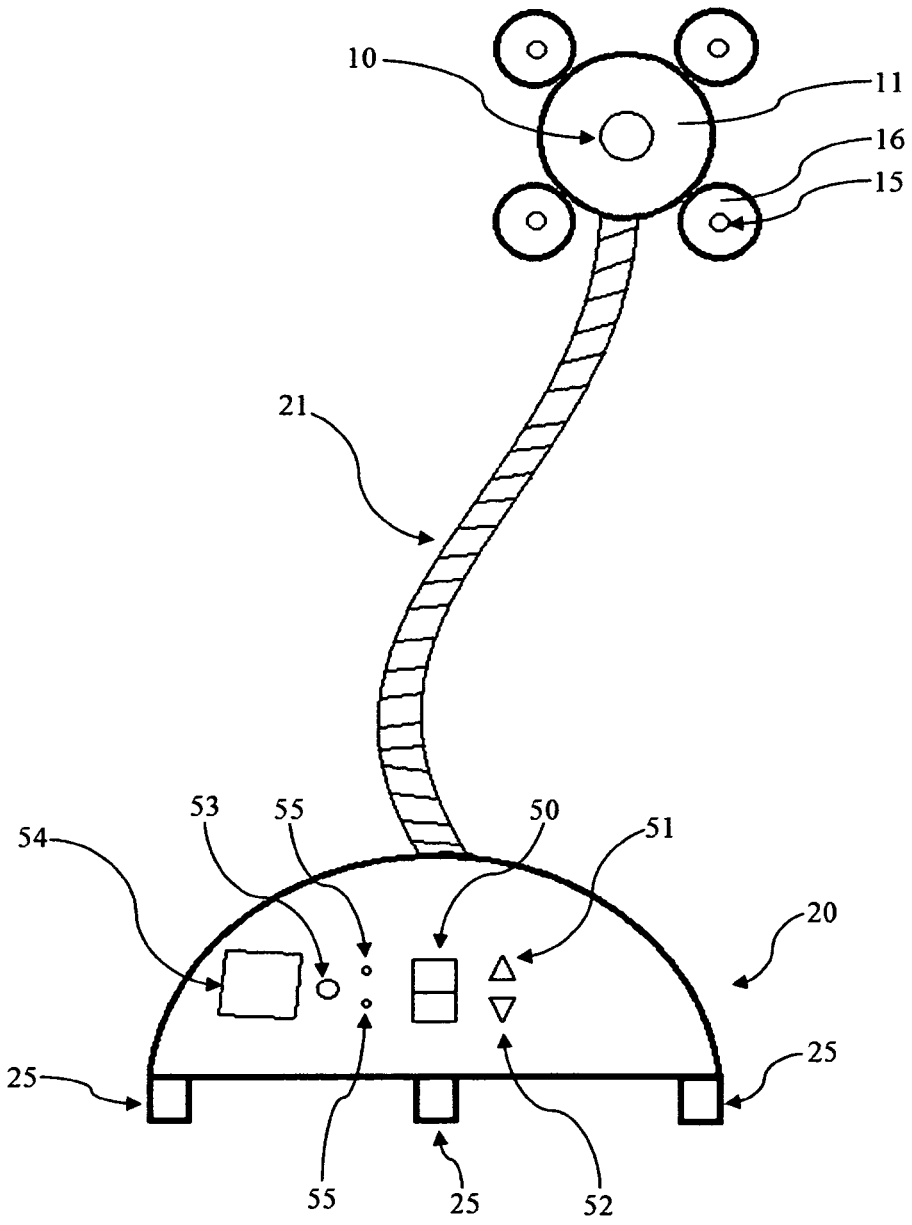
10
11
16
15
21
53
55
50
51
54
20
25
25
55
25
52

DESKTOP READING, BEDSIDE READING, AND MIDNIGHT LAMP AND RELATED METHODS

BACKGROUND OF THE INVENTION

1. Field of Invention

The present invention relates a lamp, features for such a lamp, and associated methodology. More specifically, the lamp aspect of the present invention involves at least two types of Light Emitting Diode (LED) lamps for use for lighting, wherein: (a) one or more "main" LED lamps provide the majority of the lighting when the lamp is at full brightness and no lighting during various reduced lighting states; (b) one or more "auxiliary" LED lamps provide less than a majority of the lighting when the lamp is at full brightness and all of the lighting during various reduced lighting states; and (c) means for implementing the features aspect of the invention. The features aspect of the present invention involves at least three functions including: (a) a so called "timer function" that, over a specified time period, gradually dims the main LED lamp(s) until a threshold dimness has been reached while the auxiliary LED lamp(s) are at maximum brightness, and once this threshold dimness has been reached, the main LED lamp(s) power off while the auxiliary LED lamp(s) gradually dim to the whole lamp providing no light; (b) a so called "night-time function" in which a user can activate another timer function which includes the activation of the auxiliary LED lamp(s) and may or more not include the main LED lamp(s) over another specified time period, usually a shorter time period than the timer function; and (c) a so called "alarm clock function" in which the clock on the lamp can be programmed so that the either of the main or auxiliary LED lamp(s), or both, automatically turn on gradually when one or more times of the day is reached.

2. Discussion of the Prior Art

Lamps, and especially bedside lamps, provide light for individuals laying in bed to read, to comfort children who are scared of darkness, and for various other purposes. A variety of lamps currently in the prior art include a host of features including variable dimming capabilities, adjustable positioning, and hands-off power switches such as clap-on clap-off lamps. However, for children who are scared of darkness or for adults who desire some level of light before falling asleep but complete darkness after, features of lamps currently in the prior art offer few options: plug-in night lights are usually not bright enough to provide comfort for children, and cannot be turned to a brighter setting if so desired; conventional bedside lamps—while providing enough light to comfort children—may provide too much light so that the children cannot fall asleep, and the sudden darkness from a lamp with a timer may scare unsleeping children. Therefore, parents with these types of children are left allowing children to go to bed with a light on, and must either allow the light to be left on all night or manually turning off the light when the children fall asleep, which is an act that may actually wake the children.

Ergo, the children are sleeping and need to wake momentarily to use the restroom, would like to make sure the monster they had dreamt of is not in the room, or other reasons children awake in the night. By turning on any of the lamps offered in the prior art, the process described above starts anew. Adults who want to use the restroom may have the same need.

And then when children awake in the morning in a darkened room, lamps in the prior art must be manually turned on, whether it be by a button, touch, one or more claps in the air, or various other ways. That equally applies to adults.

The present invention addresses the need for a lamp to gradually dim so as to provide light in a decreasing manner, and to provide light for a short period of time when awaking to use the restroom during midnight, and for a lamp to provide lighting automatically upon awaking at a certain time.

SUMMARY OF THE INVENTION

The present invention relates a lamp, features for such a lamp, and associated methodology. The lamp aspect of the present invention uses at least two LED lamps for use for lighting. According to an aspect of the invention, one or more "main" LED lamp(s) provide the majority of the lighting when the lamp is at full brightness and no lighting during various reduced lighting states. According to an aspect of the invention, one or more "auxiliary" LED lamp(s) provide less than a majority of the lighting when the lamp is above a brightness threshold and all of the lighting during various reduced lighting states. Both lamps are made of LEDs, dimmable between 0% to 100% continuously, in, for instance, steps of 1%. By including at least one of two different lamps (i.e., the main and auxiliary components), the lamp can achieve a wide range of brightness. The range of brightness can be divided into two sub-ranges. In the brighter of the sub-ranges, both the main LED(s) and the auxiliary LED(s) are activated. As the timer function (as discussed below) decreases the brightness in the first, brighter sub-range, the auxiliary LED(s) will be at full brightness while the main LED(s) decreases in brightness until a threshold has been met, at which point the main LED(s) will be off. At this point, the range of brightness enters the dimmer of the sub-ranges where the auxiliary LED(s) begin to dim. The wide range of brightness (and dimness) over the dimming-time (as discussed in below) achieves what prior art does not: a non-sudden decrease in lighting that allows children to fall asleep with enough light to keep them comforted. Whereas, the rate of decrease is even programmable. As discussed below, the initial brightness and dimming-time can be set according to any desired time so that more light-needy children can also be properly comforted.

According to an aspect of the invention, the lamp has a base with means for setting the three functions discussed below (i.e., the timer function, the night-time function, and the alarm clock function), and a neck which connects the base with the main and auxiliary LED(s), wherein the base or the neck, or both, contains a mechanism to turn on the lamps and a separate mechanism to activate the night-time function. The advantage of having a specified activating mechanism for the night-time function is that when children awake in the night and want to turn on a light with a lower brightness as compared with that before they went to bed, they will activate the second, usually shorter, dimmer function and so not have to turn the light back off again. This again will comfort the child in that they can go back to sleep with a light on, which will dim as they fall asleep.

According to an aspect of the invention, the lamp has a clock with a light-alarm-clock function wherein: the clock displays the time, and the alarm clock function allows the user to set a specified time(s) when the lamps will be turned on. The light-alarm-clock function offers an enhanced feature above provided in the prior art: it provides light to children upon waking without the child having to turn on the light him- or her-self.

The aspect of the present invention relating to the features of the lamp involves at least three functions in which the lamp has the means for implementing the features aspect of the invention. According to an aspect of the invention, one feature involves a so called "timer function" that, over a specified time period, gradually dims the main LED lamp(s) until a threshold dimness has been reached while the auxiliary LED lamp(s) are at maximum brightness, and once this threshold dimness has been breached the main LED lamp(s) power off while the auxiliary LED lamp(s) gradually dims to the whole lamp providing no light. The operation of the timer feature involves at least three steps. First, the user sets the desired dim-time, which is the time (in minutes, hours, other segments of times) from starting the timer until all lamps are turned completely off. Second, the user adjusts the starting desired brightness by dimming up or dimming down the current brightness until a desired starting brightness is achieved. Once the user is satisfied with the starting brightness, the third and final user step is to activate the timer function. The lamp includes a means for activating the timer function—whether it be by push button, touch screen, or any other means for activating a switch. Once activated, the timer function will automatically dims on continuously from the starting brightness until the time set by the user in step one where there is no brightness.

According to an aspect of the invention, the timer function dims the main LED lamp(s) entirely while the auxiliary LED lamp(s) are at full power. According to an aspect of the invention, after the timer function turns off the main LED lamp(s), the auxiliary LED lamp(s) begin to dim from full brightness to completely off. By dimming the main LED lamp(s) before dimming the auxiliary LED lamp(s), the invention offers an enhanced spectrum of brightness because of the use of at least two differently powered (and therefore lighted) LED(s) of different spectra, namely, one or more brighter main LED(s) and one or more dimmer auxiliary LED(s). Using these at least two different powered LED(s), numerous implementation-specific dimming patterns can be achieved, ranging from a linear dimming pattern of both the main and auxiliary LED(s) to a log function dimming pattern to the main or auxiliary LED(s), or both, or a combination of these patterns and other patterns, all of which are decisions that must be made to achieve the developer's specific goals.

According to an aspect of the invention, one feature involves a so called "night-time function" in which a user can activate a secondary timer function. The operations of the one or more secondary timer functions is the same as the timer function discussed above, but which includes the activation of the auxiliary LED lamp(s) and may or more not include the main LED lamp(s) over another user-specified time period—usually a shorter time period than the timer function. The activation of the night-time function is contemplated to be easily-accessible to children among waking in a dark room, whether it be the said neck of the lamp or the said base of the lamp or any other component of the lamp, or any combinations of these. The activation could be by touch, a button, or any other means of activation. By having a secondary timer function which is called the night-time function, the invention offers children a way to turn on a light in a dark room and automatically activate another time frame in which, like previously discussed in the timer function, will dim brightness over time. The purpose of having this function, and not the timer function, easily activated is that it allows children to activate the light but on a shorter timer than activating the timer function—allowing the child to use the restroom, guaranteeing there are no monsters in the room, etc., and then allowing the child to get tucked back into bed with a light without worrying about having to turn the light off.

Finally, according to an aspect of the invention, one feature involves a so called "alarm clock function" in which the clock on the lamp can be programmed so that the either of the main or auxiliary LED lamp(s), or both, automatically turn on when one or more times of the day is reached. This feature offers the advantage that children awake in the morning in an automatically lighted room, i.e., in which they do not have to manually turn on the lamp.

BRIEF DESCRIPTION OF THE DRAWINGS

FIG. 1 is a perspective exploded view of a lamp including a base member, one main LED lamp with mounting, four auxiliary LED lamp(s) with mountings, a neck, and various buttons to achieve the timing function, the night-time function, and the alarm clock function as well as according to an aspect of the present invention.

DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. The whole lamp, features for such a lamp, and associated methodology disclosed herein boasts a variety of inventive features and components that warrant patent protection, both individually and in combination.

FIG. 1 is a perspective exploded view of a lamp including a base member 20, three legs 25, one main LED lamp 10 with main reflector 11, four auxiliary LED lamp(s) 15 with auxiliary reflectors 16, a neck 21, a screen 54 possibly made of LCD, indicators 55, and four buttons including the on-off switch 50, the up-button 51, the down-button 52, and the mode-selection button 53, all of which will have various functions under different selection and functional modes according to an aspect of the present invention.

By way of example only, there is one main LED lamp 10 and four auxiliary LED lamp(s). It is contemplated that any number of main and auxiliary LED lamp(s) can be used to achieve various ranges of brightness by using various LED bulb strength in both the main LED lamp(s) and the auxiliary LED lamp(s). For concreteness, but by way of example only, the main LED lamp 10 in this embodiment would provide around 80% of the full brightness while the four auxiliary lights combined would provide the remaining 20% of the full brightness. The main LED lamp 10 and the four auxiliary LED lamp(s) 15 are made of LED, dimmable between 0% to 100% continuously, in steps of 1% of total brightness. In this embodiment, each of the four auxiliary LED lamp(s) would be equivalent to 10 W equivalent of tungsten halogen, totally 40 W. The main LED lamp 10 would be equivalent to 160 W of tungsten halogen. In this embodiment, the threshold at which the main LED lamp 10 would shut off during the timing function or the night-time function is 20% of full brightness. It has also been contemplated, but not discussed in this embodiment, that one main LED lamp 10 of 120 W and two auxiliary LED lamp(s) 15 of 15 W each of tungsten halogen equivalent could be used in the design. The main reflector 11 and auxiliary reflectors 16, which surround the LEDs and directs the light in a controlled direction so that actual beam of light does not point into the users eyes, are colored, say red, externally and white internally to maximize the reflection, and are 100% opaque.

The mode-selection button 53 is used for toggling between two sequential modes of operation, i.e. normal dimming with dimming level shown from 0% to 100% to timer or sleeping mode and then back to normal dimming as shown on the screen 54. By way of example only, the screen 54 in this embodiment is on whenever the normal dimming mode is activated and continues to be on after the "timer" mode is activated, and one minute after the "timer" mode has been activated, the screen 54 is automatically turned off unless the neck 21 is touched (as discussed below). Once touched, the screen 54 is on for only one minute if the "timer" mode is still activated.

Indicators 55 are lights, say LEDs, covered by a flat diffuser flush with the surface of the base and it is used to indicate the two modes of "normal dimming" and "timer" respectively. The indicators 55 are just for indication and must be weak and flush with the surface of the base. It is contemplated that one indicator with two colors could be used to accomplish the same function.

By way of example only, the neck 21 is a linked support of the reflector and is a flexible metallic hose, bendable and rigid, of 600 mm in length. By way of example only, the base is of saucer shape, made of materials that are non-conducting but static charge sensitive, weighing 3 kg in weight, and flat bottom with three legs 25, the bottom of which made of velvet, rubber, suction cups, or other materials or mechanism that will help prevent sliding. The purpose of a heavy base is stability, especially considering the children will be reaching for the lamp after awaking from sleep and in a dark room. The purpose of the three legs is to cater for an unflattened surface. The on-off switch 50 is installed on the base member 20.

The lamp is equipped with a clock, either a 24-hour or 12-hour format, shown on the screen 54. As discussed below, the user can adjust the clock in HH:MM:SS as it is a parameter to be set. By way of example only, the clock then always appear on the screen 54 under both the "normal dimming" mode or the "timer" mode. It is contemplated that the lamp can also include, and the user can also set, an alarm bell on the clock to go along with the alarm-clock function discussed below. The user can adjust all the settings through a programmable parameters menu.

The programmable parameters menu on the screen includes seven parameters: (a) the brightness when the lamp is turned on, what we call the "start-up brightness," (b) the preset brightness level of touching the night-time activating mechanism under "timer" mode, what we call the "restroom brightness", (c) the brightness when the alarm clock activates the light, what we call the "wake-up brightness," (d) time length for "timer" mode dimming to zero brightness, what we call "dimming time", (e) the time from touching the night-time activating mechanism under "timer" mode until the light turns off, what we call "potty time," (f) a clock (set-able to the minute), (g) an alarm-clock (set-able to the minute), which can be deactivated.

Here, it is assumed that the down-button 52 and up-button 51 are used to control the brightness, i.e., when pressed once, the down-button 52 (up-button 51) decreases (increases) the brightness by a preprogrammed amount, such as 1%, 2%, or 5% of full brightness, or any other amount. However, it is contemplated that any adjustment mechanism can be used instead of the down-button 52 and up-button 51. For instance, a sliding bar to adjust brightness could be used to achieve the same control function. By way of example only, if either the down-button or the up-button is held continuously, the rate of change of brightness will be 1% per 0.1 second but continuously, or any other rate depending on the particular application. The current dimming value is shown on the screen 54, within a range from 100% to 0%, in steps of 1%. The indicators 55 shows this mode as well. The screen 54 is still on even if the brightness is dimmed down to 0% under such normal dimming mode. If a sliding bar is used, the dimming level is changed continuously as per status of the sliding bar.

Normally, the screen 54 only shows the current time and the level of brightness. But when both up-button 51 and down-button 52 are pressed simultaneously, the screen 54 then shows the seven parameters together with their current values, but of which are not highlighted. When the user scrolls up and down the seven selections by using the up-button 51 and the down-button 52, the different parameters will be boxed around the parameter to be selected. Upon the desired parameter to be selected and changed (i.e., the parameter with the box around), the user selects the parameter to change by pressing the mode-selection button 53. That current selected value of the parameter is then highlighted and the user can change the current selected value by the two dimming buttons 51 and 52. Note that under this parameter setting mode, the mode selection button has a new function to pick a parameter. Once a parameter is highlighted, the user can use the up-button 51 and the down-button 52 to change the default value cyclically. When a desirable value is achieved, the mode-selection button 53 is pressed again and the parameter is de-hightlighted. After all or some of the seven parameters are set, the up-button 51 and the down-button 52 are pressed again simultaneously and the "normal dimming" mode returns. And all seven parameters have been well adjusted.

By way of example only, the timer function could be set such that the main LED lamp 10 and auxiliary LED lamp(s) 15 would gradually dim down from 60% of full brightness to 20% of brightness, at which the main LED lamp 10 would shut off while the four auxiliary LED lamp(s) 15 would be at full brightness, and then the four auxiliary LEDs would dim from 20% of full brightness to 0% of full brightness. By way of example only, the time period of dimming in this embodiment could be set from 1 minute to 90 minutes in increments of 5 minutes (but increments of 1 minute from 1 minute to 5 minutes) at which point the lamp turns off completely.

Down-button 52 and up-button 51 are used to dim down or dim up until desired brightness, respectively. Once the user is satisfied with the initial brightness by using the down-button 52 and up-button 51, the user presses the mode-selection button 53, which in this case activates the timer function.

For concreteness, consider the following operation of the timer function. The user turns on the lamp for the first time using the on-off switch 50 at which point the lamp is at the preset startup brightness (e.g., the preset brightness is one of the seven parameters discussed above). If the dimming time is not set to the desired amount of time, the user then sets the dimming time to, for example, 30 minutes. Next, the user adjusts the brightness to the desired brightness, say, 60% of full brightness. Finally, when the user is ready to begin the timer function, the user simply presses the mode-selection button 53. Initially after selecting the "timer" mode, the screen 54 is still on and the brightness of the main LED lamp 10 and the auxiliary LED lamp(s) 15 is the same as the current brightness and user cannot dim up and down anymore using down-button 52 or up-button 51. In other words, the user must properly dim the brightness to the desired value before the "timer" mode is activated. When under the "timer" mode, the user can re-activate the "normal dimming" mode by pressing the mode-selection button 53 once more. Such action can be done whenever the "timer" mode has been activated, which the user can determine by viewing the indicators 55. But when the "normal dimming" mode is re-activated, the brightness will remain the same as the current brightness under the "timer" mode.

Back to the concrete example when the mode-selection button 53 is pressed. At that point, the indicators 55 will display that the lamp is in the timer mode and the timer function calculates the dimming rate of both the main LED lamp 10 and four auxiliary LED lamp(s) 15. Specifically, and by way of example only, if the timer function utilized a linearly decreasing dimmer, and given these pre-programmed settings—a dimming time of 30 minutes and initial brightness of 60%—the timer function would calculate the a dimming rate of 2% per minute (i.e., 60% brightness divided by 30 minutes). Therefore, because the main LED lamp 10 shuts off in this embodiment at 20% of full brightness, the time before the main LED lamp 10 turns off is 20 minutes (i.e., there is 40% brightness between the initial brightness of 60% and the amount of brightness when the main LED lamp 10 turns off, at 20%, and so 40% brightness divided by 2% brightness per minute equals 20 minutes). Thus, during the 20 minutes after the mode-selection button 53 is pressed, the four auxiliary LED lamp(s) 15 will remain at their full brightness while the main LED lamp 10 decreases at a linear rate of 2% per minute until turned off at minute 20. Upon reaching minute 20, the auxiliary LED lamp(s) 15 will begin to dim at a rate of 2% of full brightness per minute until at minute 30 when the auxiliary LEDs 15 will be turned off and the timer function completed.

At any time during the timer mode, i.e., after the mode-selection button 53 is pressed but before the set time clocks out, the user can press the mode-selection button 53 anytime to switch the mode back to "normal dimming" mode while the brightness will be the same as the moment right before it is pressed. The screen 54 and indicators 55 will display this change accordingly.

By way of example only, the neck 21 is the activating mechanism for the night-time function. That is, if the user touches the neck 21 while the lamp is off but while in timer mode, the night-time function will turn on the main LED lamp 10 and auxiliary LED lamp(s) 15 to the pre-programmed restroom brightness (whether the main LED lamp is turned on or not very much depends on the restroom brightness being set by the user), and then activate a secondary timer function that uses the restroom brightness and the potty time. It would be appreciated to consider that the secondary timer function could be activated by means other than touching the neck 21, and the function of the dimmer could follow a different mathematical function than the first timer mathematical function discussed above (e.g., the original timer function could be linear and the secondary timer function activated by the night-time function could follow a logarithmic curve).

By way of example only, the alarm clock function is set according to the programmable parameters menu as discussed above. Once the alarm time is set and the alarm clock is activated, at which point no matter what other functions are activated in between these times and no matter if any other buttons are pressed (other than turning the alarm function off or changing the alarm set time), the alarm function will turn on the auxiliary LED lamp(s) 15 and possibly the main LED lamp 10 according to the wake-up brightness when the current time matches the set time.

Having described a multitude of aspects of the present invention, including aspects of the lamp, features for such a lamp, and associated methodology, it should be understood that this invention is not limited to only those aspects described above and that changes and modifications may be made without departing from the true spirit and scope of the invention as defined in the appended claims.

What is claimed is:

1. A method of dimming lights by utilizing one or more "main" LED lamp(s) and one or more "auxiliary" LED lamp(s), where said main LED lamp(s) are providing the majority of the lighting when both said main LED lamp(s) and said auxiliary LED lamp(s) are at full brightness and no lighting during various reduced lighting states, where said auxiliary LED lamp(s) are providing less than a majority of the lighting when both said main LED lamp(s) and said auxiliary LED lamp(s) are at full brightness and all of the lighting during various reduced lighting states when the said main LED lamp(s) are turned off, comprising the steps of:

(a) requiring the user to select a preset or reset (i) desired total dimming time, which is the total amount of time from when the method being activated to said main LED lamp(s) and said auxiliary LED lamp(s) both providing 0% of full brightness, and (ii) desired start brightness, which is the brightness the method will start at when it begins to dim;

(b) activating the function;

(c) automatically deactivating user control over brightness;

(d) automatically activating a mechanism allowing user to break out of function if a break-out-mechanism is activated;

(e) decreasing brightness according to a dimming curve, which is calculated using said desired total dimming time and said desired start brightness, where the brightness of said main LED lamp(s) is decreased to 0% while said auxiliary LED lamp(s) are at full brightness and then at which point said auxiliary LED lamp(s) decrease from full brightness to 0% brightness, but if said break-out-mechanism is activated, break out of dimming curve and set brightness of LEDs at current brightness or a preset brightness.

2. A bedside lamp for use of providing a gradually dimming, comprising:

one or more "main" LED lamp(s) providing the majority of the lighting when the lamp is at full brightness and no lighting during various reduced lighting states, which turn(s) off once a brightness threshold of decreasing brightness is breached;

one or more "auxiliary" LED lamp(s) providing less than a majority of the lighting when the lamp is at full brightness and all of the lighting during various reduced lighting states when the said one or more main LEDs are turned off;

the means for implementing the method of claim 1.

3. The bedside lamp of claim 2, further comprising a night-time mechanism which is used to activate a second, additional function as described by the method of claim 1, and the means for implementing said secondary method of claim 1.

4. The bedside lamp of claim 2 or 3, further comprising the means for implementing a so called "alarm clock function" in which utilities a programmable clock on the lamp so that the either of said main LED lamp(s) or said auxiliary LED lamp(s), or both, automatically turn on when one or more set times of the day is reached.

* * * * *